US010446963B2

(12) United States Patent
Ungerer et al.

(10) Patent No.: US 10,446,963 B2
(45) Date of Patent: Oct. 15, 2019

(54) PLUG-CONNECTOR SOCKET

(71) Applicant: Amphenol-Tuchel Electronics GmbH, Heilbronn (DE)

(72) Inventors: Christian Ungerer, Untergruppenbach-Unterheinriet (DE); Wolfgang Kerner, Erlenbach (DE); Timo Zentgraf, Offenau (DE); Michael Knödler, Struttgart (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 0 days.

(21) Appl. No.: 16/411,854

(22) Filed: May 14, 2019

(65) Prior Publication Data

US 2019/0267739 A1 Aug. 29, 2019

Related U.S. Application Data

(62) Division of application No. 16/062,833, filed as application No. PCT/EP2016/080222 on Dec. 8, 2016.

(30) Foreign Application Priority Data

Dec. 15, 2015 (DE) ..... 10 2015 121 886
Dec. 18, 2015 (DE) ..... 10 2015 122 303

(51) Int. Cl.
*H01R 43/16* (2006.01)
*H01R 13/187* (2006.01)
*H01R 13/11* (2006.01)

(52) U.S. Cl.
CPC ..... *H01R 13/187* (2013.01); *H01R 13/111* (2013.01); *H01R 43/16* (2013.01)

(58) Field of Classification Search
CPC ..... H01R 43/00; H01R 43/16; H01R 13/18; H01R 13/02; H01R 13/187; H01R 13/193
(Continued)

(56) References Cited

U.S. PATENT DOCUMENTS 4,657,335 A 4/1987 Koch
6,837,756 B2 * 1/2005 Swearingen ..... H01R 4/4881 439/843

(Continued)

FOREIGN PATENT DOCUMENTS

DE 102005049134 A1 4/2007
DE 102008058203 A1 5/2010

(Continued)

*Primary Examiner* — Hien D Vu
(74) *Attorney, Agent, or Firm* — Blank Rome LLP

(57) ABSTRACT

The invention relates to an electric plug-connector socket comprising a cylindrical socket sleeve, wherein the socket sleeve is designed with an accommodating space, into which is pushed a cylindrical lamella cage with a multiplicity of parallel contact lamellae, wherein the lamella cage has a first and second end-side, encircling collar crosspiece, and the contact lamellae run therebetween, wherein the lamella cage, on both collar crosspieces, has preferably window-like apertures, and wherein a stamping method is used to introduce, into the lateral surface of the socket sleeve, a plurality of convexities which extend into the window-like apertures such that a preferably force-fitting connection is formed between the lamella cage and the socket sleeve.

4 Claims, 1 Drawing Sheet

(58) Field of Classification Search
USPC ..... 29/825, 854; 439/843, 851
See application file for complete search history.

(56) References Cited

U.S. PATENT DOCUMENTS

| | | | | |
|---|---|---|---|---|
| 9,455,514 | B2 * | 9/2016 | Hirakawa | H01R 13/02 |
| 9,484,641 | B2 * | 11/2016 | Ohkubo | H01R 13/187 |
| 2002/0187686 | A1 | 12/2002 | Zhao | |
| 2003/0068931 | A1 | 4/2003 | Swearingen et al. | |
| 2003/0077950 | A1 | 4/2003 | Swearingen et al. | |
| 2008/0268717 | A1 | 10/2008 | Mao | |

FOREIGN PATENT DOCUMENTS

| | | | |
|---|---|---|---|
| DE | 102008058204 | A1 | 5/2010 |
| DE | 102012221384 | A1 | 5/2013 |
| DE | 102011105821 | B4 | 9/2013 |
| DE | 102013203546 | A1 | 9/2014 |
| WO | WO-2014095365 | A1 | 6/2014 |

* cited by examiner

PLUG-CONNECTOR SOCKET

RELATED APPLICATIONS

This application is a divisional of U.S. patent application Ser. No. 16/062,833, filed Jun. 15, 2018, which is a national stage application of International Application No. PCT/EP2016/080222, filed Dec. 8, 2016, which is related to and claims priority to German Patent Application No, 10 2015 122 303.1, filed Dec. 18, 2015, and German Patent Application No. 10 2015 121 886.0, filed Dec. 15, 2015, the entire disclosures of which are hereby incorporated by reference.

The invention relates to an electrical plug-connector socket which is configured as a radial contact socket and has a plurality of longitudinal contact elements for making contact with a corresponding plug pin and also has a sleeve which surrounds the longitudinal contact elements.

The present invention further relates to a method for producing an electrical plug-connector socket formed with a plurality of longitudinal contact elements for making contact with a corresponding plug and having a socket sleeve which surrounds the longitudinal contact elements.

US 2002/0187686 A1 discloses a socket having a T-shaped connection and also the manufacture of a lamella contact, comprising a lamella cage and a rolled contact holder which can be turned in the form of an "hourglass" in a complex manner and with the aid of various tools.

Similarly, U.S. Pat. No. 4,657,335 describes a socket which is formed by a relative rotational movement of the ends of a lamella cage into a sleeve. Rings are placed one over the other at the respective ends of the sleeve in order to secure the lamella cage in the sleeve.

US 2003/0068931 A1 discloses an electrical plug-connector socket comprising a substantially cylindrical socket sleeve which is provided with recesses at its end-side ends in order to fasten a hyperbolically rotated lamella cage, with its connection tongues, to or in said recesses.

DE 10 2011 105 821 B4 further discloses an electrical plug-connector socket having a cylindrical socket sleeve, wherein the socket sleeve is formed with a receiving space in which a hyperbolically rotated lamella cage is fitted, and the socket sleeve has a first and a second end face and the lamella cage, by way of connection tongues, is connected in an interlocking manner to the socket sleeve on the first and the second end face of said socket sleeve and that apertures are made in the transition region between the socket sleeve and the connection tongue, and that at least one of the connection tongues of the lamella cage protrudes through one of the apertures.

The solutions known in the prior art all have the disadvantage that manufacture is very complicated, in particular the geometric dimensions of sleeves, end-side sleeves and lamella cages also have to be matched to one another. Manufacturing considerations lead to a tolerance field, and this creates considerable practical problems. In general, high-precision pipes have to be used since, in each case, the inner pipe of the lamella cage has to fit into the pipe shape of the surrounding sleeve and the surrounding sleeve in turn may have to be inserted into a further sleeve receptacle and have to be fastened there.

Contact systems of the kind in which a cylindrical, in particular cylindrically rolled, contact grid has to be fastened to the two end-side collar webs in the sleeve surrounding the contact grid and tolerances have to be matched to one another present a considerable problem.

Therefore, in general, plug-connector sockets of the generic type comprise an inserted contact grid which is connected to the sleeve by means of complicated material joining methods (such as welding for example). Nevertheless, a precision pipe is generally required in order to have at least the inside diameter in a relatively small tolerance field. Secondly, the contact grid and the collar webs which are typically formed on said contact grid are nevertheless subject to manufacturing tolerances of the kind that result in manufacturing-related difficulties in conventional joining methods.

The object of the present invention is therefore to overcome the abovementioned disadvantages and to manufacture a plug-connector socket in a substantially simpler and more economical manner taking into account potentially relatively high tolerances, wherein, at the same time, the number of components is intended to be reduced but a high current-carrying capacity is still ensured under a high temperature loading, in particular at temperatures of between 150° and 170°, and in some cases has to be reliably ensured at higher temperatures.

The invention is achieved by a plug-connector socket having the features of claim 1 and also by a method according to the features of claim 9.

The basic idea of the present invention is to not join the cylindrical lamella cage to one or both ends by way of a joining process (such as welding for example) as in the prior art, but rather to provide recesses at the first end of the lamella cage, into which recesses convex portions of the sleeve are deformed by means of a stamped connections in order to fix the lamella cage in the sleeve, then to twist the lamella cage possibly through a specific angle (in order to form a hyperbolically shaped lamella cage therefrom) and, in a further step, to deform convex portions of the sleeve into recesses, which are provided at the other end of the sleeve, by means of further stamped connections.

Therefore, an electrical plug-connector socket comprising a cylindrical socket sleeve is provided according to the invention, wherein the socket sleeve is formed with a receiving space in which a cylindrical lamella cage having a large number of contact lamellae which run in parallel is inserted, wherein the lamella cage has a first and a second end-side circumferential collar web, the contact lamellae running between said collar webs, wherein the lamella cage has preferably window-like recesses on the two collar webs, and wherein a plurality of convex portions are made in the casing of the socket sleeve by a stamping process, said convex portions extending into the window-like recesses in such a way that a preferably force-fitting connection is formed between the lamella cage and the socket sleeve.

In an advantageous refinement of the invention, it is provided that two or more window-like recesses or openings are arranged on the first and the second collar web at the edge of the respective collar web such that the respective recess is open to the respective edge at the end side and is preferably shaped or formed as an end-side toothed portion.

It is further advantageous when two or more window-like recesses or openings, each with a length L as viewed in axial direction (A), are provided on the first and the second collar web, convex portions which are respectively provided on the inner wall of the socket sleeve and have a respectively virtually identical length L' engaging into said recesses or openings, so that axial movement of the respective collar web is prevented in this way.

In an advantageous refinement of the invention, it is provided that window-like recesses with a width B as viewed transverse to the axial direction (A) are provided on the first and the second collar web, convex portions which are provided on the inner wall of the socket sleeve and have an identical or almost identical width B' engaging into said recesses, so that turning of the respective collar web is prevented.

It is further advantageous when the fastening means are provided on the socket sleeve as stamped portions in the casing of the socket sleeve, wherein indentations are formed on the outer almond of the socket sleeve and projecting convex portions are formed on the inner casing of the socket sleeve.

In an advantageous refinement of the invention, it is provided that the fastening means are in the form of substantially cuboidal convex portions with in each case two opposite longitudinal side edges and in each case two opposite lateral side edges.

It is further advantageous when the lamella cage has a smaller diameter in a central middle section as viewed in axial direction (A) than at the collar webs, preferably formed by one collar web of the lamella cage having been twisted in relation to the other collar web.

A further aspect of the present invention relates to a method for producing an electrical plug-connector socket as described above, comprising the following method steps:

a. producing a contact lamella grid with two end-side collar webs having a large number of parallel contact lamellae which run between said collar webs;
b. making two or more window-like openings, which are open at the end side, in the two collar web of the contact lamella grid and transforming the contact lamella grid into a cylindrical lamella cage,
c. providing a socket sleeve with a receiving space and inserting the lamella cage into the receiving space;
d. fitting convex portions, which protrude into the receiving space, to the inner casing of the socket sleeve, preferably by stamping in a manner corresponding to the recesses of the first collar web in such a way that the corresponding convex portions engage in the window-like openings and secure one collar web, and also
e. fitting further convex portions, which protrude into the receiving space, to the inner casing of the socket sleeve, preferably by stamping in a manner corresponding to the recesses of the second collar web in such a way that the corresponding convex portions engage in the window-like openings on the second collar web and secure said collar web.

A twisting or rotary movement of the second collar web in relation to the first collar web advantageously takes place between step d) and step e).

Further refinements of the invention can be gathered from the patent claims and also the figures and the associated description of the figures, wherein in the figures of the drawings:

The invention will be explained in more detail below with reference to the following exemplary embodiment which is illustrated in FIGS. 1 to 4. In so doing, identical reference symbols indicate identical functional or structural features.

Figures 1, 2, 3, 4:
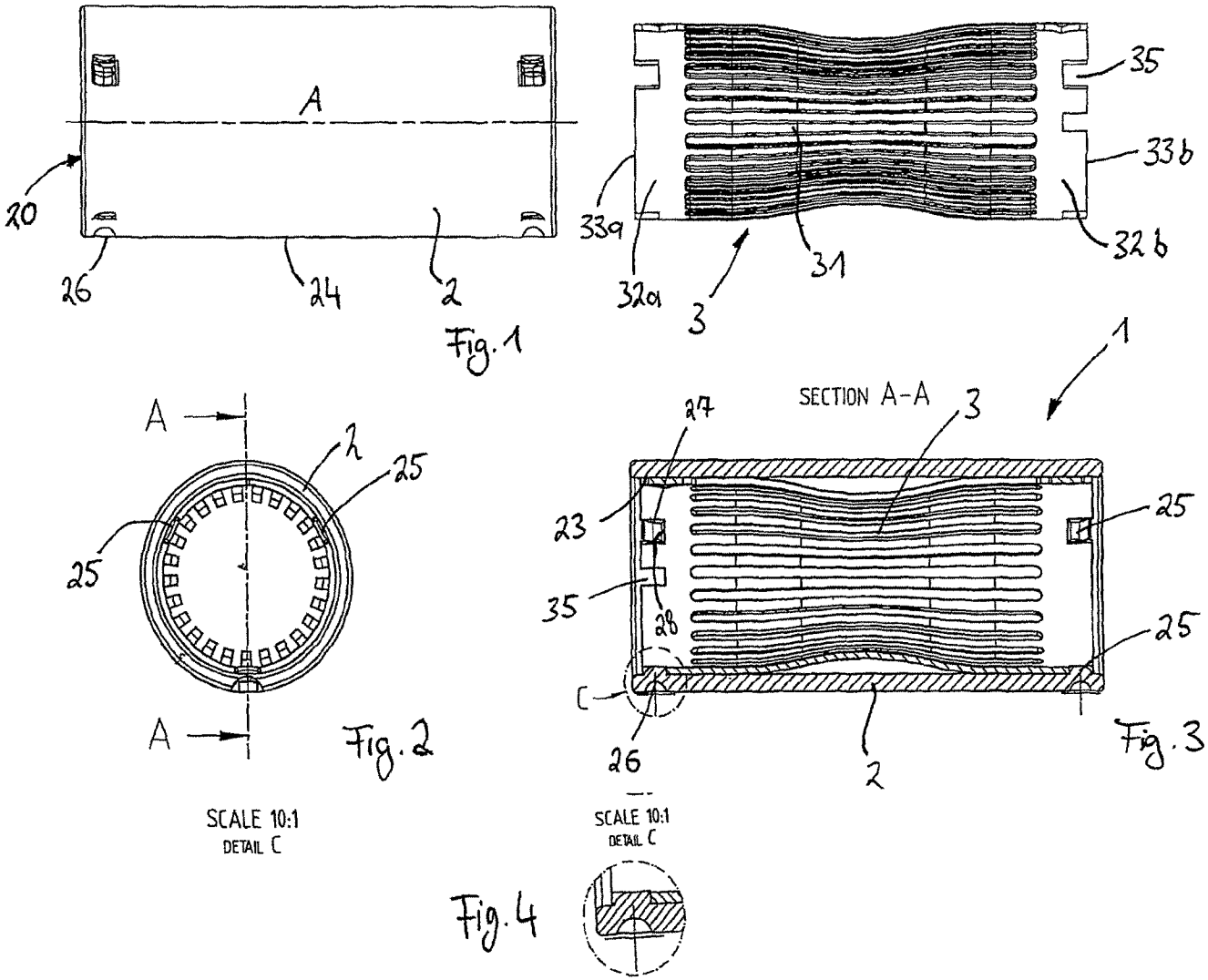
FIG. 1 shows a side view of a socket sleeve with a lamella grid illustrated next to it.
FIG. 2 shows an end-side view of a fitted plug-connector socket.
FIG. 3 shows a sectional view along section line A-A from FIG. 2.
FIG. 4 shows the detail C from FIG. 3.

FIG. 1 shows a side view of a socket sleeve 2 with a lamella grid 3 illustrated next to it, wherein the socket sleeve 2 is formed with a receiving space 20 into which a cylindrical lamella cage 3 having a large number of contact lamellae 31, which run in parallel, is inserted in FIGS. 2 and 3.

The cylindrical and tubular socket sleeve 2 has a casing 7 which is closed at the circumference and is open at the two ends.

The lamella cage 3 has a first and a second end-side circumferential collar web 32*a*, 32*b*, a large number of contact lamellae 31 running between said collar webs. The contact lamellae 31 run substantially parallel to one another so as to form a gap between in each case two adjacent contact lamellae 31.

The lamella cage 3 has window-like recesses 35 on the two collar webs, said recesses being open to the respective edge 33*a*, 33*b* at the end side.

A plurality of convex portions 25, as can be seen in FIGS. 2 to 4, are inserted into the casing of the socket sleeve 2 by a stamping method, said convex portions extending into the window-like recesses 35 in such a way that a preferably force-fitting connection is formed between the lamella cage 3 and the socket sleeve 2.

Furthermore, indentations 26 are formed on the outer almond 24 of the socket sleeve 2 and projecting convex portions 25 are formed in the casing 7 opposite said indentations.

The implementation of the invention is not restricted to the preferred exemplary embodiments described above. Rather, a number of variants are feasible which make use of the illustrated solution even for embodiments of a fundamentally different nature.

The invention claimed is:

1. A method for producing an electrical plug-connector socket, comprising the following method steps:

a. producing a contact lamella grid with two end-side collar webs and having a number of contact lamellae which run between said two collar webs;
b. making two or more window-like openings in the two collar webs of the contact lamella grid and transforming the contact lamella grid into a cylindrical lamella cage;
c. providing a socket sleeve with a receiving space and inserting the cylindrical lamella cage into the receiving space;
d. fitting convex portions which protrude into the receiving space to an inner casing of the socket sleeve by stamping in a manner corresponding to the window-like openings of one of the two collar web in such a way that the corresponding convex portions engage in the window-like openings and secure the one collar web, the corresponding convex portions having a substantially identical length with a length of the corresponding window-like openings of one of the collar webs; and
e. fitting further convex portions, which protrude into the receiving space to the inner casing of the socket sleeve by stamping in a manner corresponding to the window-like openings of the other of the two collar webs in such a way that the corresponding convex portions engage in the window-like openings on the other collar web and secure said other collar web, the corresponding convex portions having a substantially identical length with a length of the corresponding window-like openings of one of the other collar webs.

2. The method as claimed in claim 1, wherein a twisting or rotary movement of the other collar web in relation to the one collar web takes place between step d) and step e).

3. A method for producing an electrical plug-connector socket, comprising the following method steps:

a. producing a contact lamella grid with two end-side collar webs and having a number of contact lamellae which run between said two collar webs;

b. making at least one window-like opening in the two collar webs of the contact lamella grid and transforming the contact lamella grid into a cylindrical lamella cage;

c. providing a socket sleeve with a receiving space and inserting the cylindrical lamella cage into the receiving space;

d. fitting at least one convex portion which protrudes into the receiving space from an inner casing of the socket sleeve by stamping in a manner corresponding to the at least one window-like recess or opening of the one collar web in such a way that the corresponding convex portion engages in the window-like recess or opening to secure the one collar web, the corresponding convex portions having a substantially identical length with a length of the corresponding window-like openings of the at least one of the collar webs; and e. fitting at least one further convex portion which protrudes into the receiving space to the inner casing of the socket sleeve by stamping in a manner corresponding to the window-like openings of the other of the two collar webs in such a way that the corresponding convex portions engage in the window-like openings on the other collar web and secure said other collar web, the corresponding convex portions having a substantially identical length with a length of the corresponding window-like openings of the at least one of the other collar webs.

4. The method as claimed in claim 3, wherein a twisting or rotary movement of the other collar web in relation to the one collar web takes place between step d) and e).

* * * * *